United States Patent [19]

Laurie

[11] Patent Number: 4,905,393

[45] Date of Patent: Mar. 6, 1990

[54] SLIDING FILE TAB AND COMPATIBLE FILE FOLDER

[76] Inventor: Charles T. Laurie, 4427 Blossom St., M-3, Columbia, S.C. 29205

[21] Appl. No.: 66,192

[22] Filed: Jun. 25, 1987

[51] Int. Cl.[4] ..... G09F 23/10

[52] U.S. Cl. ..... 40/641

[58] Field of Search ..... 40/641, 359, 360

[56] References Cited

U.S. PATENT DOCUMENTS

| | | | |
|---|---|---|---|
| 782,071 | 2/1905 | Smith | 40/23 A |
| 1,164,721 | 12/1915 | Hub et al. | 40/641 |
| 1,513,929 | 11/1924 | Rand | 40/641 |
| 1,826,614 | 10/1931 | Graff et al. | 40/23 A |
| 2,207,657 | 7/1940 | Chamberlin | 281/42 |
| 2,405,374 | 8/1946 | Sinter, Jr. | 281/42 |
| 3,001,306 | 9/1961 | Wilkinson | 40/23 A |
| 3,054,202 | 9/1962 | Scholfield | 40/23 A |
| 3,164,917 | 1/1965 | Harper | 40/23 A |
| 3,245,162 | 4/1966 | McEroy | 40/23 A |
| 3,552,047 | 1/1971 | Dalziel | 40/23 A |
| 4,127,690 | 11/1978 | Schleifenbaum | 40/23 A |
| 4,563,796 | 1/1986 | Kettlestrings | 40/23 A |

FOREIGN PATENT DOCUMENTS

| | | | |
|---|---|---|---|
| 345066 | 3/1931 | United Kingdom | 40/360 |

*Primary Examiner*—Robert P. Swiatek
*Assistant Examiner*—Cary E. Stone

[57] ABSTRACT

The present invention consists of a particular separate identifying tab which is designed to slide or stay put on the edge of a compatible file folder for the purpose of maximizing the visibility of all tabs in a file drawer. Stability of the tab on the folder edge is obtained by means of a tab made of hard laminated cardboard (or any other material with the same properties of friction and lightweight); a fork base whose sides are proximate enough to maintain a grip by friction on the folder edge; and a thin, sturdy, and pliable pressure-sensitive low-tack adhesive flap extending from the fork base, which flap, when applied to the surface of the folder, reinforces the stability of the tab on the edge of the folder. Mobility of the tab on the folder edge is obtained by peeling the flap from the surface of the folder and applying moderate pressure against the side of the tab in the direction desired. Concomitant with the tab is a folder whose edges run straight across the length of the folder without any die-cuts and which is about half an inch shorter than file folders currently in use so that when the tab is put in place the total height of the folder is the same as that of current folders. The purpose of this invention is to facilitate the filing and retrieving of documents by disposing the identifying in a manner which will maximize the visibility of all tabs in a file drawer and thus avoid the laborious and time-consuming task of thumbing through folders to find any needed file or the proper space in which to place a file.

5 Claims, 1 Drawing Sheet

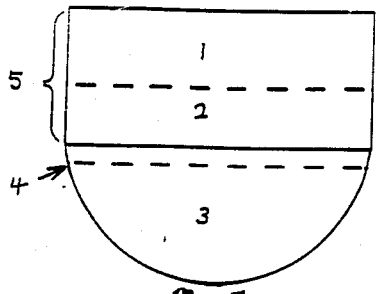
fig.1
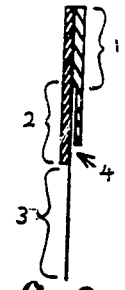
fig.2
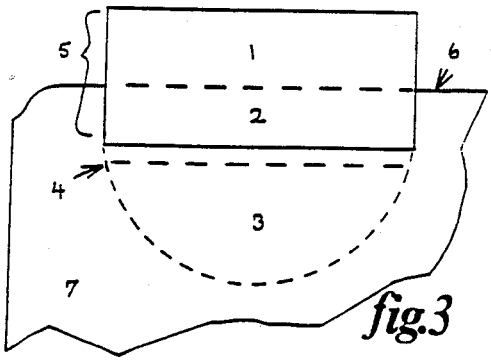
fig.3
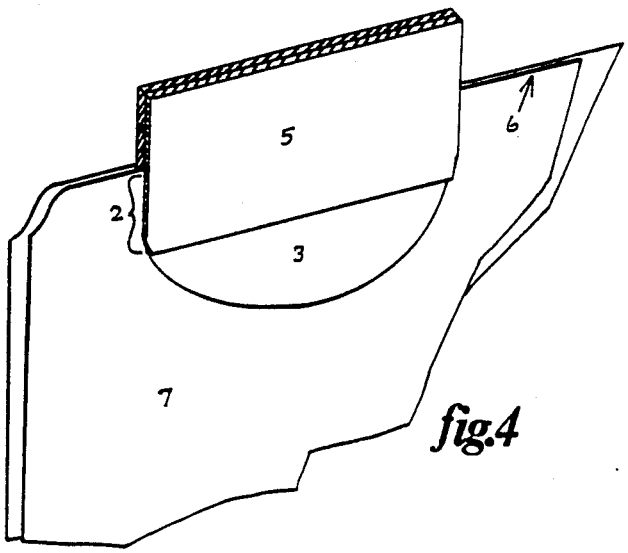
fig.4
fig.5
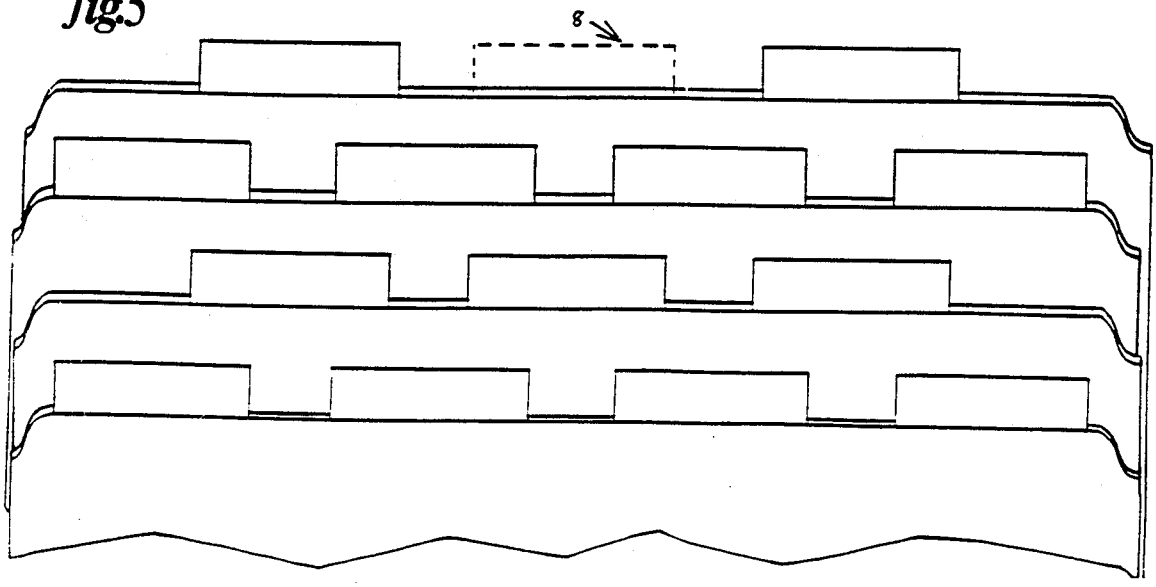

SLIDING FILE TAB AND COMPATIBLE FILE FOLDER

BACKGROUND OF THE INVENTION

1. Field of the Invention

The field of the invention is office equipment, with particular reference to filing systems. Reference is made to a concept and device consisting of a sliding tab and a compatible file folder for facilitating the filing and retrieval of documents.

2. Description of the Prior or Background Art

Names on file folders are currently shown on the top strip of the inside of folders within a section which is exposed to view by a die-cut built into the front side of the folder. Names may be written directly on that exposed part, or labels may be affixed thereto on which names are written or typed.

The undesirable aspect of this pattern is that the names of folders tend to be concealed behind folders in front so that one generally has to thumb through folders to find the desired file. This is laborious and time consuming. Folders inadvertently placed in nonalphabetical arrangement are often hard to find and involve time, effort, and aggravation.

Attempts have been made to maximize the visibility of tabs by producing folders wherein recesses on the front side of the folder are disposed across the width of the folder. Some patterns of folders come in three recesses and some in five. However, folders with the needed recesses have not always been available to the file clerk. And even whey they were, the adjustment potential has been limited, so that many file names inevitably wind up behind file names directly in front of them.

SUMMARY OF THE INVENTION

This invention provides a simple and effective means of facilitating the filing and retrieval of documents. It provides separate name tabs and permits adjusting their position on file folders in a manner to obtain maximum view of all tabs.

Stability of the tab on the folder edge is obtained by means of a forklike base, FIGS. 2 and 4 (2), its grip upon the folder edge by friction, FIGS. 3 and 4 (6), and a pressure-sensitive adhesive flap extension, FIGS. 3 and 4 (3), designed to apply to the folder surface, FIGS. 3 and 4 (7).

Mobility of the tab along the folder edge is obtained by peeling the flap, FIGS. 3 and 4 (3), from the surface of the folder, FIGS. 3 and 4 (7), and moving the tab, FIGS. 3 and 4 (5), along the folder edge, FIGS. 3 and 4 (6), by applying moderate pressure against one side of the end in the direction desired.

The tab and fork base are made of laminated cardboard of sufficiently hard texture, the sides of the fork being proximate enough to provide a firm grip upon the folder edge; and the flap is made of a thin and pliable material (paper, soft cardboard, fabric, or any other suitable substitute) with a low-tack pressure-sensitive adhesive coating on the inner side.

The tab needs to have the friction, light weight, and simplicity provided by cardboard or any other suitable substitute with the same properties. The friction is essential for maintaining the stability of the tab on the folder edge. The light weight is needed for preventing the standing folder to buckle under the weight of the tab. The simplicity of the device is essential for maintaining a cost effectiveness suitable for application to the countless folders involved in most filing systems.

A folder with edges that are straight and flush across the width of the folder is needed for the purpose of the present device. See FIG. 5.

BRIEF DESCRIPTION OF THE DRAWINGS

FIG. 1 is a frontal view of the sliding tab. The tab consists of the upper strip (1) on which the name of the file is shown, of the lower strip which is the fork base (2), and a thin pliable pressure-sensitive adhesive flap extension (3). The dotted line at 4 represents the short extra length (1/16th to ⅛th of an inch) of one side of the fork for easier insertion of the folder edge. In FIG. 1, the side of the fork which is slightly longer is in back of the tab, as indicated by the dotted line at 4.

FIG. 2 is a side view of the sliding tab in FIG. 1 with the thin pliable adhesive flap (3) extending from the back side of the tab. The strip for the name of the file is at 1, the fork base at 2, and the flap at 3. In this perspective, the adhesive coating is on the name side of the tab so that when the tab is placed on the folder edge the coating will be on the side which comes in contact with the back of the folder.

FIG. 3 is a frontal view of the sliding tab (5) sitting on the edge (6) of a file folder, with flap extension on the back side of the folder (as indicated by the dotted line) adhering to the folder surface 7. The unseen side of the fork slightly exceeds the depth of the front side, as shown by the dotted lines at 4.

FIG. 4 is a back perspective view of the sliding tab disposed obliquely to reveal a depth perception of the tab fork (2) resting on the folder edge (6).

FIG. 5 presents a front perspective of the disposition of tabs on four standing folders in a file drawer. In this picture, each tab rests on the far side of each folder so that the flap would be in back of each folder and unseen in this overall picture. With flap peeled, each tab may be moved in either direction along the edge of the folder to maximize visibility of all tabs. Where a row becomes overcrowed, a new row may be created. In FIG. 5 there is space for a tab in the middle of the top row, as indicated by the dotted lines (8).

DESCRIPTION OF THE PREFERRED EMBODIMENTS

The tab (5) consists of two small rectangular pieces of hard cardboard, about 1"×2" to 3", a front portion and a back portion, glued together at the upper half (1) so that the lower half (2) forms a slit into which the edge (6) of a file folder (7) may be inserted. The bottom parts of the front and back portions remain separated but with no space between them other than the fine slit created by the separation.

Glued to the bottom edge of the back portion of the forked base (2) is a thin pliable flap (3), preferably arcuate in design, on the front side of which is a pressure-sensitive low-tack adhesive coating, such coating being about ¼ inch away from the rim for easy handling of the flap when being removed from the surface to which it may be attached. The flap may be glued directly on to the bottom edge of the back portion or may be attached thereto by means of a connecting adhesive piece of tape.

The invention involves a combination of the said index tab (5) and a compatible file folder (7) wherein said tab (5) may slide back and forth along the edge (6) of the back leaf of the folder (7) as it stands in a file drawer. The edges of the folder run straight across the width of the folder without any recesses impeding such sliding back and forth. They also run flush with each other to permit viewing of the tab at all points.

The main body of the tab may, of course, be produced as one integral piece by means of a die cut. In that case, the slit formed at the lower half of the main body should be no wider than the width of the intended insert, namely, the edge of a file folder.

If the device is made of thin sturdy plastic, the connection between the flap and the main body may be done by gluing in the manner described above for the device made in sturdy cardboard or by producing the flap as an integral part of the main body, the flap being a thinned-out and pliable extension from the front part of the bottom edge of the back leaf of the forked base.

The cardboard used should be of sufficient hardness to effect a good grip on the edge of the folder, and the flap should be thin and pliable so that it may be handled easily and effectively when it is being attached to or peeled from the folder surface.

The stability of the tab is obtained by means of the sides of the forked base being proximate enough to create friction and by the additional firming effect of the adhesive flap attaching to the surface of the folder.

The mobility of the tab is obtained by peeling the flap from the folder surface and applying moderate pressure against one side of the tab in the direction desired.

The bottom edge of the back portion of the forked base fork protrudes about ⅛th to 1/6th of an inch to permit easy placement of the tab on the edge of the folder.

Different width tabs may be provided in order to facilitate the rearrangement of tabs along a row.

The tabs are disposed in a manner to maximize visibility of all tabs at one glance. The tabs may be slid to the left or to the right as needed to maintain maximum visibility. In some cases a partial view of a tab may be allowed if the visible information on the tab sufficiently reveals the name of the file. If space in a row is lacking, then a new row may be created. The number of tabs in a row may, of course, be altered as needed.

Whether the tab be made of sturdy cardboard, sturdy thin plastic, or any other similarly lightweight material, it is important that the device be lightweight so that the standing folder does not buckle under its weight.

The material used plus the design of the article is such that compactness will be obtained, a requirement essential in an efficient filing system.

The material used plus the design also guarantee cost effectiveness, an essential requirement in view of the great number of folders involved in most filing systems. of the tab when the article is being readied for packaging.

Also, whenever a folder is put away in permanent storage, the tab may be additionally secured by an adhesive tape overlay.

I claim as my invention:

1. An index tab for use on a file folder, said index tab comprising:

(a) a front rectangular portion made of a sheet of sturdy cardboard;

(b) a back portion comprising a similar sheet of cardboard;

(c) top parts of the front and back portions, said top parts located adjacent to the top edges of the portions and being glued to each other, a top portion of the front portion presenting a surface on which names of files or other indicia may be shown;

(d) bottom parts of the front and back portions, said bottom parts located adjacent to the bottom edges of the portions and being unattached with no space therebetween other than a slit created by the unattached bottom parts;

(e) a flap of resilient material extending from the bottom edge of the back portion, and being glued on to the bottom edge of the back portion and having a low-tack adhesive coating on the side of the flap facing the front portion for adhesion to the back of the folder.

2. The combination of an index tab and a file folder, (A) the index tab comprising:

(a) a front rectangular portion made of a sheet of sturdy cardboard;

(b) a back portion comprising a similar sheet of cardboard;

(c) top parts of the front and back portions, said top parts located adjacent to the top edges of the portions and being glued to each other, a top portion of the front portion presenting a surface on which names of files or other indicia may be shown;

(d) bottom parts of the front and back portions, said bottom parts located adjacent to the bottom edges of the portions and being unattached with no space therebetween other than a slit created by the unattached bottom parts;

(e) a flap of resilient material extending from the bottom edge of the back portion, and being glued on to the bottom edge of the back portion and having a low-tack adhesive coating on the side of the flap facing the front portion for adhesion to the back of the folder;

(B) said file folder comprising: a substantially straight top edge, said top edge permitting the index tab to be slid therealong.

3. An index tab for use on a file folder, said index tab comprising an integral one-piece body having a front wall connected to a back wall by a bridging portion located at the top edge of the walls, the bridging portion creating a space between the walls that is no greater than the thickness of the file folder, and a flexible flap attached to the bottom edge of the back wall and having a low-tack adhesive on the surface facing the front wall.

4. The index tab of claim 3, wherein said body is made of plastic.

5. The index tab of claim 3, wherein said flap is an extension of the back wall and has a thickness less than that of said back wall so that said flap is flexible.

* * * * *

UNITED STATES PATENT AND TRADEMARK OFFICE

CERTIFICATE OF CORRECTION

PATENT NO. : 4,905,393

DATED : March 6, 1990

INVENTOR(S) : Charles T. Laurie

It is certified that error appears in the above-identified patent and that said Letters Patent is hereby corrected as shown below:

ON THE TITLE PAGE-

Under ABSTRACT, 2nd column, 5th line from bottom:
Please add "tabs" after "identifying"

Under SUMMARY OF THE INVENTION, column 1:
line 54 Please change "end" to "tab"
line 67 Please change "to buckle" to "from buckling"

Under DESCRIPTION OF PREFERRED EMBODIMENTS, column 3, lines 53-4:
Please delete:
"of the tab when the article is being readied for packaging"

Under CLAIMS, column 4:
line 2 Please add "or the like" after "cardboard"
line 4 Please add "or the like" after "board"
line 22 Please add "or the like" after "cardboard"
line 24 Please add "or the like" after "cardboard"
line 56 Please add "or the like" after "plastic"

Signed and Sealed this

Eleventh Day of June, 1991

*Attest:*

*Attesting Officer*

HARRY F. MANBECK, JR.

*Commissioner of Patents and Trademarks*